US010981261B2

(12) United States Patent
Kass et al.

(10) Patent No.: US 10,981,261 B2
(45) Date of Patent: Apr. 20, 2021

(54) CONTAINER CLAMP ASSEMBLY

(71) Applicant: Indian Springs Mfg. Co. Inc., Baldwinsville, NY (US)

(72) Inventors: Alex Kass, Baldwinsville, NY (US); Wendy Marie Racha, Baldwinsville, NY (US); Raymond Scott Racha, Baldwinsville, NY (US); Robert James Wolniak, Baldwinsville, NY (US)

(73) Assignee: INDIAN SPRINGS MFG. CO. INC., Baldwinsville, NY (US)

( * ) Notice: Subject to any disclaimer, the term of this patent is extended or adjusted under 35 U.S.C. 154(b) by 0 days.

(21) Appl. No.: 16/630,191

(22) PCT Filed: Jul. 13, 2018

(86) PCT No.: PCT/US2018/042031
§ 371 (c)(1),
(2) Date: Jan. 10, 2020

(87) PCT Pub. No.: WO2019/014556
PCT Pub. Date: Jan. 17, 2019

(65) Prior Publication Data

US 2020/0164489 A1 May 28, 2020

Related U.S. Application Data

(60) Provisional application No. 62/532,144, filed on Jul. 13, 2017.

(51) Int. Cl.
*B25B 5/10* (2006.01)
*B25B 5/16* (2006.01)

(52) U.S. Cl.
CPC ..... *B25B 5/101* (2013.01); *B25B 5/16* (2013.01)

(58) Field of Classification Search
CPC .... B25B 1/00; B25B 1/12; B25B 1/24; B25B 5/00; B25B 5/06; B25B 5/10; B25B 5/101; B25B 5/14; B25B 5/16
See application file for complete search history.

(56) References Cited

U.S. PATENT DOCUMENTS 1,459,093 A * 6/1923 French ..... B25B 5/003 269/156
1,477,219 A 12/1923 Halvorsen
1,670,253 A 5/1928 Gilbert et al.
2,420,002 A 5/1947 McKay
(Continued)

OTHER PUBLICATIONS

ISA/U.S. International Search Report and Written Opinion from PCT International Appl. No. PCT/US2018/042031, completed Aug. 31, 2018 (dated Sep. 27, 2018).
(Continued)

*Primary Examiner* — Robert Sandy
*Assistant Examiner* — David M Upchurch
(74) *Attorney, Agent, or Firm* — Barclay Damon LLP

(57) ABSTRACT

A clamping assembly includes a body defining a retaining area and at least one coupling element. The body further includes a first leg having an adjustable engagement member and a second leg positioned at an angle less than 90° relative to a horizontal axis. The clamping assembly further includes a rod having a first end coupled to the at least one coupling element of the body. The rod is operative to drive the body in a direction toward the first leg in response to a force directed toward a second end of the rod.

11 Claims, 12 Drawing Sheets

(56) References Cited

U.S. PATENT DOCUMENTS 3,883,128 A 5/1975 Breese
4,183,571 A * 1/1980 Renfroe ..... B66C 1/48 269/271
4,747,590 A * 5/1988 Yang ..... B25B 5/003 269/249
4,903,929 A * 2/1990 Hoffman ..... B25B 5/003 24/335
5,005,890 A * 4/1991 Schwenger ..... B66C 1/48 294/103.1
5,135,209 A * 8/1992 Penny ..... B25B 5/101 269/249
5,255,950 A * 10/1993 Davies ..... B66C 1/64 294/101
5,312,097 A * 5/1994 Womack ..... B25B 5/003 269/139
5,322,253 A 6/1994 Stevens
5,690,604 A * 11/1997 Barnett ..... A61H 19/44 248/229.15
5,893,553 A * 4/1999 Pinkous ..... B25B 5/101 269/143
5,950,998 A 9/1999 Crabb
7,387,296 B2 * 6/2008 Alberti ..... B25B 5/067 269/143
7,891,618 B2 2/2011 Carnevali
8,496,236 B2 * 7/2013 Merhar ..... F16B 7/0473 269/3
9,121,423 B2 * 9/2015 Sharpe ..... F16M 11/105
10,029,351 B2 * 7/2018 Hopf ..... B25B 5/166
2006/0108729 A1 5/2006 Siegel
2006/0231723 A1 * 10/2006 Fayerman ..... A01K 97/10 248/540

OTHER PUBLICATIONS

International Preliminary Examining Authority, International Preliminary Report on Patentability, PCT International Appl. No. PCT/US2018/042031, dated Sep. 30, 2019.

* cited by examiner

CONTAINER CLAMP ASSEMBLY

CROSS REFERENCE TO RELATED APPLICATION

This application claims the benefit and priority of U.S. Patent Application Ser. No. 62/532,144, filed Jul. 13, 2017, and entitled, CONTAINER CLAMP, the entirety of which is incorporated herein by reference.

TECHNICAL FIELD

This application is directed generally to the field of clamping devices and more specifically to a clamping assembly for a chemical container having a first leg and a second leg, where the clamping assembly is configured to exhibit increased gripping power in response to an upward force exerted on the clamping device.

BACKGROUND

Many products and manufacturing processes require the use of chemicals. Chemicals, specifically liquid and gaseous chemicals, are typically stored and transported in containers that are equipped with valves, which couple to pipes or hoses that allow the chemicals to be dispensed into and out of the containers. These containers may also be equipped with fuse valves that comprise a threaded portion holding a solid plug. The solid plug is comprised of a material which melts at a certain temperature in order to release built up pressure inside the container to prevent explosions. Such containers vary in size and may include one-ton containers as well as railway tank cars used in trains. The valves are surrounded by a protective housing, which prevents the valves from being sheared off should a container be dropped or the tank car become derailed in a train accident. The protective housing includes several holes positioned around the circumference of protective housing that allow the pipes or hoses connected to the valves to pass through. The storage and transport containers are configured specifically for the chemical that they will contain. As such, the valve arrangement and even the size of the protective housing will differ between containers. Damage to a valve may cause leakage of the chemicals from the container leading to environmental contamination.

Currently, kits are sold that enable a leaking valve (or fuse plug) to be temporarily plugged, sealed, or capped to avoid such hazardous conditions until valve, or pressure relief device (or fuse plug) replacement can be performed. Some of these kits are tailored specifically to the type of container on which they will be used. For example, a Chlorine Institute Emergency Kit-C would need to be used to plug a leaking valve on a chlorine rail car. Setting up or installing the kits onto a chemical container requires that all hoses and pipes be removed from the valves, including the valves that are not damaged.

The kit generally comprises a containment assembly, which includes two or more coupling elements that couple the containment assembly to the holes of the protective housing or other preexisting feature positioned on the chemical container. A bridge member is attached to the two or more coupling elements and has a drive member. The drive member applies a downward force onto a hood, which covers the leaking valve and prevents chemical contamination of the surrounding environment. The downward force applied to the hood causes the bridge to lift up, which engages the coupling elements, thereby exerting an opposing force. The opposing force secures the hood and the containment assembly in place.

However, only being able to couple to preexisting holes or other features on the protective housing greatly limits the positioning of the containment assembly and can cause increased strain on the bridge as it is always required to span the entire diameter of the protective housing. Moreover, the multiple heavy components make assembly and disassembly of the containment assembly difficult and time consuming. Other kits provide a more universal containment assembly that can be used with multiple types of chemical containers. However, these assemblies also require that all hoses and pipes to be removed from the valves during use, including the valves that are not damaged. The coupling elements are also configured to engage preexisting holes in the protective housing thereby, limiting the positioning of the bridge and increasing bridge strain. Furthermore, the heavy components of this type of apparatus make assembly and disassembly difficult and time consuming.

The foregoing background describes some, but not necessarily all, of the problems, disadvantages and shortcomings related to current container clamps and related containment assemblies. There is a general and pervasive need in the field to provide a container clamp that is universally compatible with various types of containers, easy to install, and with superior gripping ability.

SUMMARY

An embodiment of a clamping assembly comprises a body having a coupling element. The body further comprises a forward surface and a rearward surface, a first leg, an second leg, and a cross member configured to couple the first leg to the second leg. An adjustable engagement member coupled to the first leg and at least one gripping element is positioned on the adjustable engagement member. A plurality of gripping elements is positioned on the second leg. The clamping assembly further comprises a rod having a first end coupled to the at least one coupling element of the body and is configured to drive the body in a direction toward the first leg in response to a force directed toward an opposing second end of the rod.

In another embodiment, a clamping assembly comprises a body that comprises a first leg defining an opening and an second leg positioned at an angle less than 90° relative to a horizontal axis. A plurality of gripping elements are coupled to the second leg and a cross member couples to the first leg at one end and the second leg at an opposite end. An adjustable engager is at least partially positioned within the opening. An extension pivotally couples to the body at one end and is configured to drive the body in a direction toward the first leg in response to a force directed toward an opposing second end of the extension.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION

The following discussion relates to various embodiments of a container clamp assembly as used with a containment assembly. It will be understood that the herein described versions are examples that embody certain inventive concepts as detailed herein. To that end, other variations and modifications will be readily apparent to those of sufficient skill. In addition, certain terms are used throughout this discussion in order to provide a suitable frame of reference with regard to the accompanying drawings. These terms such as "first", "second", "outer", "inner", "top", "bottom", "forward", "rearward", "interior", "exterior", "front", "back" and the like are not intended to limit these concepts, except where so specifically indicated. With regard to the drawings, their purpose is to depict salient features of the inventive container clamp and are not specifically provided to scale.

Figure 1:
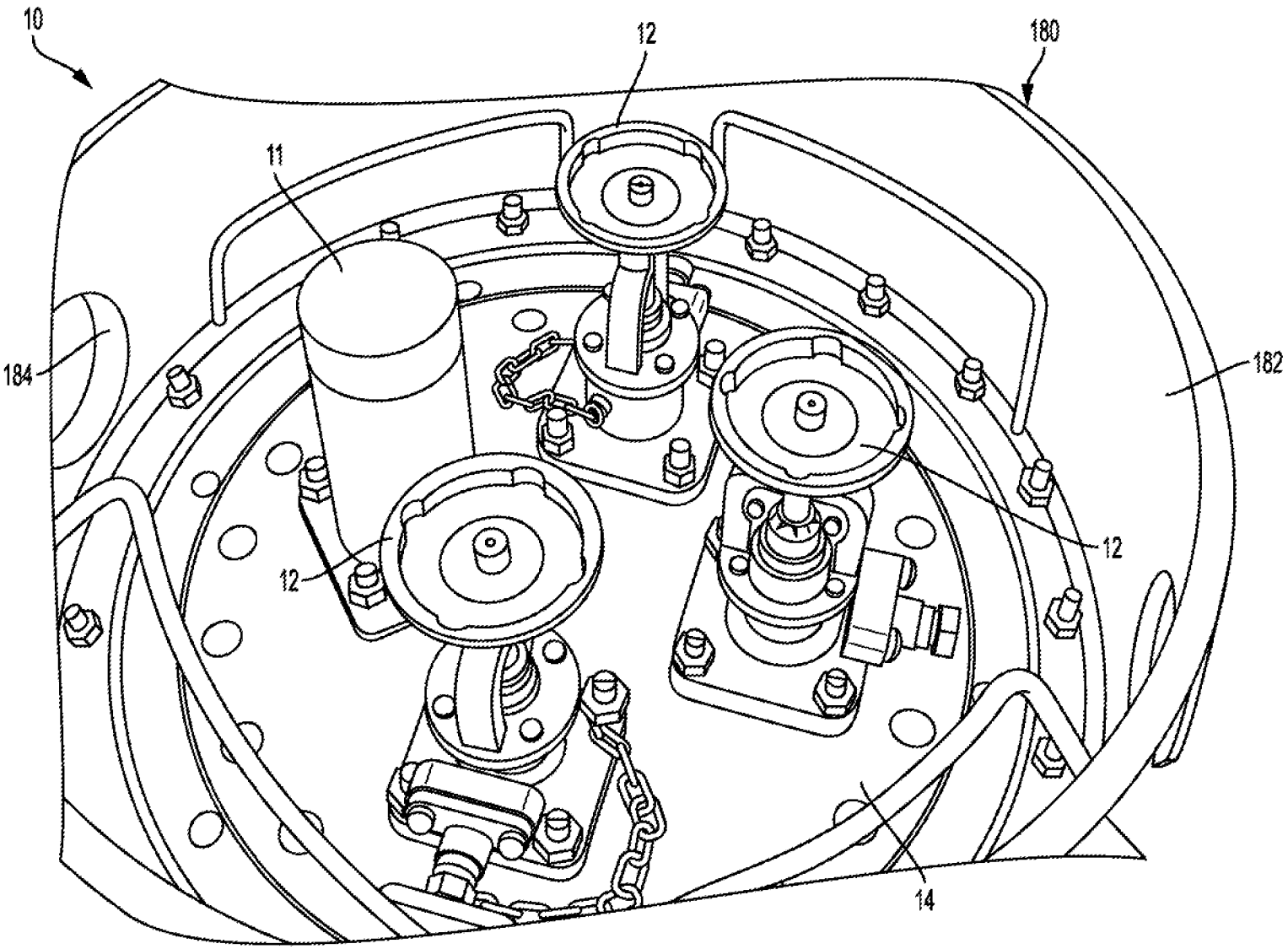
FIG. 1 illustrates an isometric view of an embodiment of a valve arrangement surrounded by a protective housing.

FIG. 1 shows an example of a valve arrangement 10 for a storage/transport container where the valves 12 are in a closed position. The valve assembly 10 comprises one or more fuse plugs 11 and/or valves 12 that are surrounded by a protective housing 180 having a side wall 182. As shown, the protective housing 180 extends upwards from the transport container to a height above the one or more fuse plugs 11 and/or valves 12. The side wall 182 of the protective housing 180 may define one or more preexisting holes 184 or openings. A series of bars, rails, or other engagement features 14 may be coupled to the protective housing 180 and configured to aid in the dispensing of material from the valves 12 or the plugging of the valves 12 in case of a leak.

Figure 2:
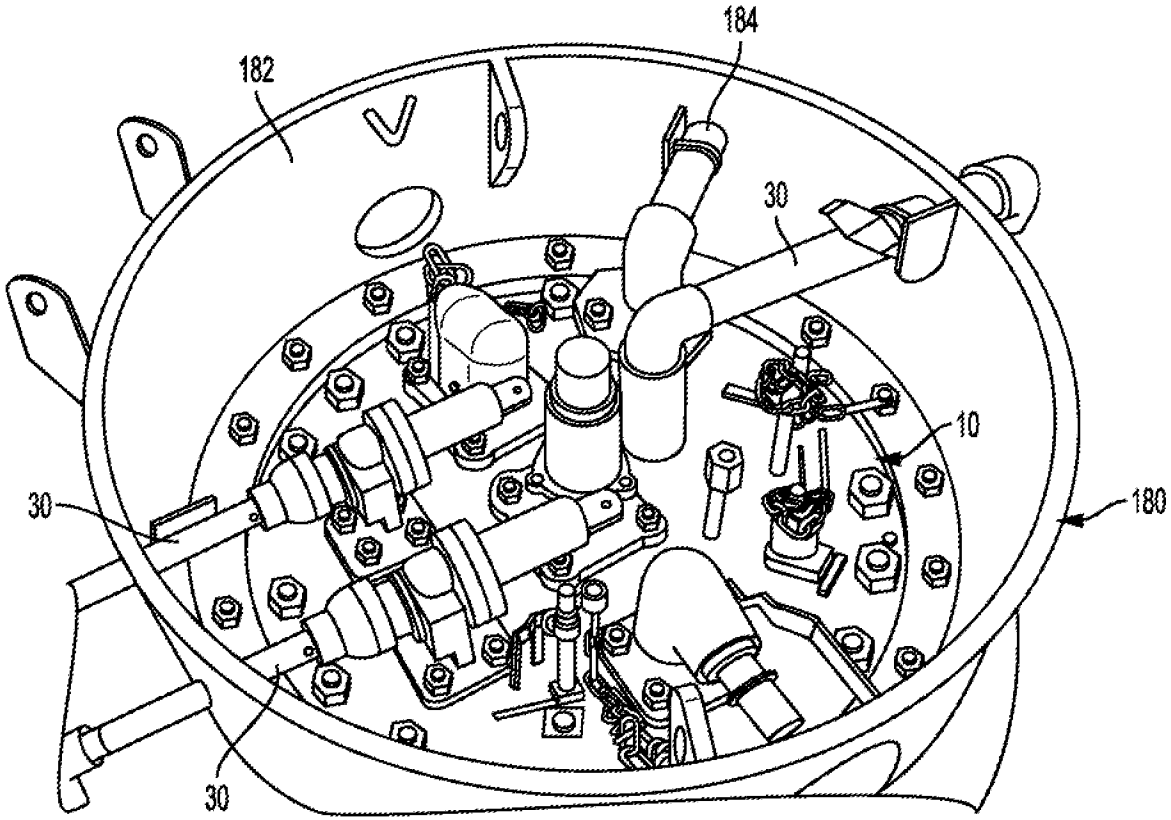
FIG. 2 illustrates an isometric view of an embodiment of the valve arrangement surrounded by the protective housing with one or more of the valves connected to a pipe or tube.

FIG. 2 illustrates an example of a valve arrangement 10 for a storage/transport container where a plurality of hoses/pipes are connected to the valves 12 (FIG. 1). The one or more valves 12 (FIG. 1) are coupled to additional pipes/hoses 30, or other suitable transport channels that remove material from the container or may be used to fill the container. As shown in FIG. 2, the pipes/hoses 30 are configured to pass through the one or more preexisting holes 184 in the side wall 182 of the protective housing 180.

Figure 3:
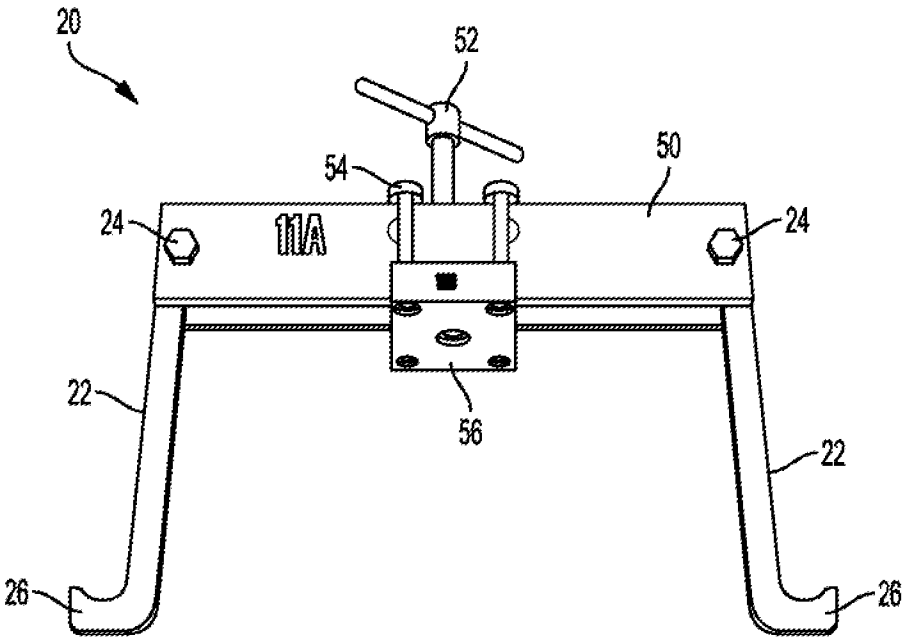
FIG. 3 PRIOR ART
FIG. 3 illustrates an isometric view of a prior art containment assembly.

The prior art containment assemblies 20, as shown in the embodiment of FIG. 3, generally comprise a bridge 50 with a driver 52 that is pivotally coupled at each end to one or more legs 22 by means of a bar 24 or pin. The legs 22 may each have hook ends 26 configured to engage preexisting holes 184 (FIGS. 1 and 2) or other engagement features 14 (FIG. 1) on the protective housing 180 (FIGS. 1 and 2) of a container or other part of the container. In other prior art containment assemblies, the hook ends 26 may be configured to be closed around a portion of the protective housing 180 (FIGS. 1 and 2) upon engagement with the preexisting holes 184 (FIGS. 1 and 2) of the protective housing 180 (FIGS. 1 and 2) or the other engagement features 14 (FIG. 1). As such, the fixed position of the legs 22, the preexisting holes 184 (FIGS. 1 and 2), and any other engagement features 14 on the protective housing 180 (FIGS. 1 and 2) or the storage/transport container limit the positioning of the prior art container assemblies 20 when being used to contain a leaking valve. Referring to the valve assembly shown in FIG. 2, the coupling of the prior art containment assembly 20 (FIG. 3) to the protective housing 180 requires securing the legs 22 through the preexisting holes 184 in the protective housing 180. Should any of the pipes/hoses 30 connected to the valves pass through the same preexisting hole(s) 184 that will secure the legs 22, they must be disengaged from the valves 12 and removed from the preexisting holes 184 prior to set up of the prior art containment assembly 20. The same holds true when the prior art containment assembly 20 is engaged with or coupled to one or more other engagement features 14. The fixed position of the legs 22 along the bridge 50 (FIG. 3) and the position of the engagement features 14 similarly limits the placement of the prior art containment assembly 20 such that one or more of the pipes-hoses 30 (FIG. 2) will have to be disengaged from its corresponding operating valve 12 (FIG. 1) in order to effectively contain the leaking valve.

Figure 12:
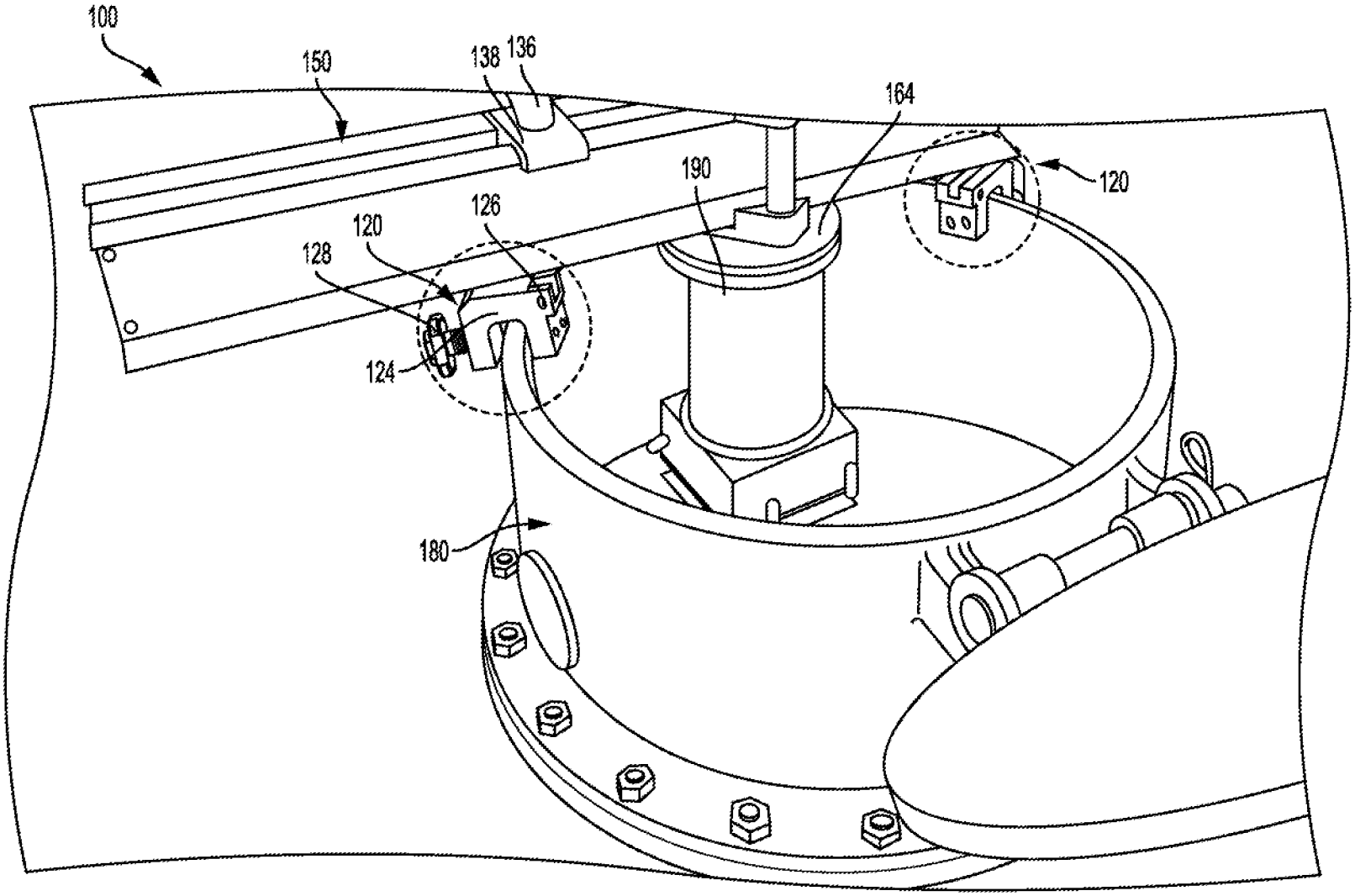
FIG. 12 illustrates a perspective view of an embodiment of the container clamp assemblies coupled to an embodiment of the containment assembly.

Once the hook ends 26 are engaged in the preexisting holes 184 (FIGS. 1 and 2) or engaged with the engagement features 14 (FIG. 2), the bridge 50 is attached to each leg 22 by the bar 24 at an end that is opposite the hook end 26. Once the bridge 50 is coupled to the legs 22, the driver assembly 51 is then coupled to the bridge 50. The driver assembly 51 comprises a driver 52 configured to be driven to bring a driver plate 56 into contact with and apply pressure in an axial direction to a hood 190 (FIG. 12) that has been placed over the leaking valve. As shown in FIG. 3, one or more screws 54 are at least partially positioned within the driver plate 56 to achieve additional mechanical coupling or contact with the hood 190 (FIG. 12). As the driver 52 applies downward pressure to the driver plate 56 and therefore to the hood 190 (FIG. 12), the bridge 50 is forced in the opposite, upward direction. The movement of the bridge 50 in the opposite direction is constrained by the engagement of the hook ends 26 on the protective housing 180 (FIGS. 1 and 2) or the storage/transport container. This creates a force opposing that of the driver 52 and allowing for a secure interaction between the driver plate 56 and the hood 190 (FIG. 12).

Engagement of the hook ends 26 with preexisting holes 184 (FIGS. 1 and 2) in the side wall 182 (FIGS. 1, 2, and 6) of the protective housing 180 (FIGS. 1, 2, and 12) means that positioning of the prior art containment assembly 20 is limited to the location of the preexisting holes 184 (FIGS. 1 and 2) in the side wall 182 of protective housing 180 (FIGS. 1 and 2) and/or of the rails 14 (FIG. 2). Accordingly, a longer bridge 50 is usually required to span the distance between the preexisting holes. Moreover, the positioning of the containment assembly 10 as necessitated by the preexisting holes 184 (FIG. 2) causes obstruction of functional valves during the sealing of the leaking valve. As a result, the prior art containment assemblies 20 essentially disables an entire set of valves in order to secure a single leaking valve 12 (FIG. 1) or fuse plug 11 (FIG. 1).

Figure 4:
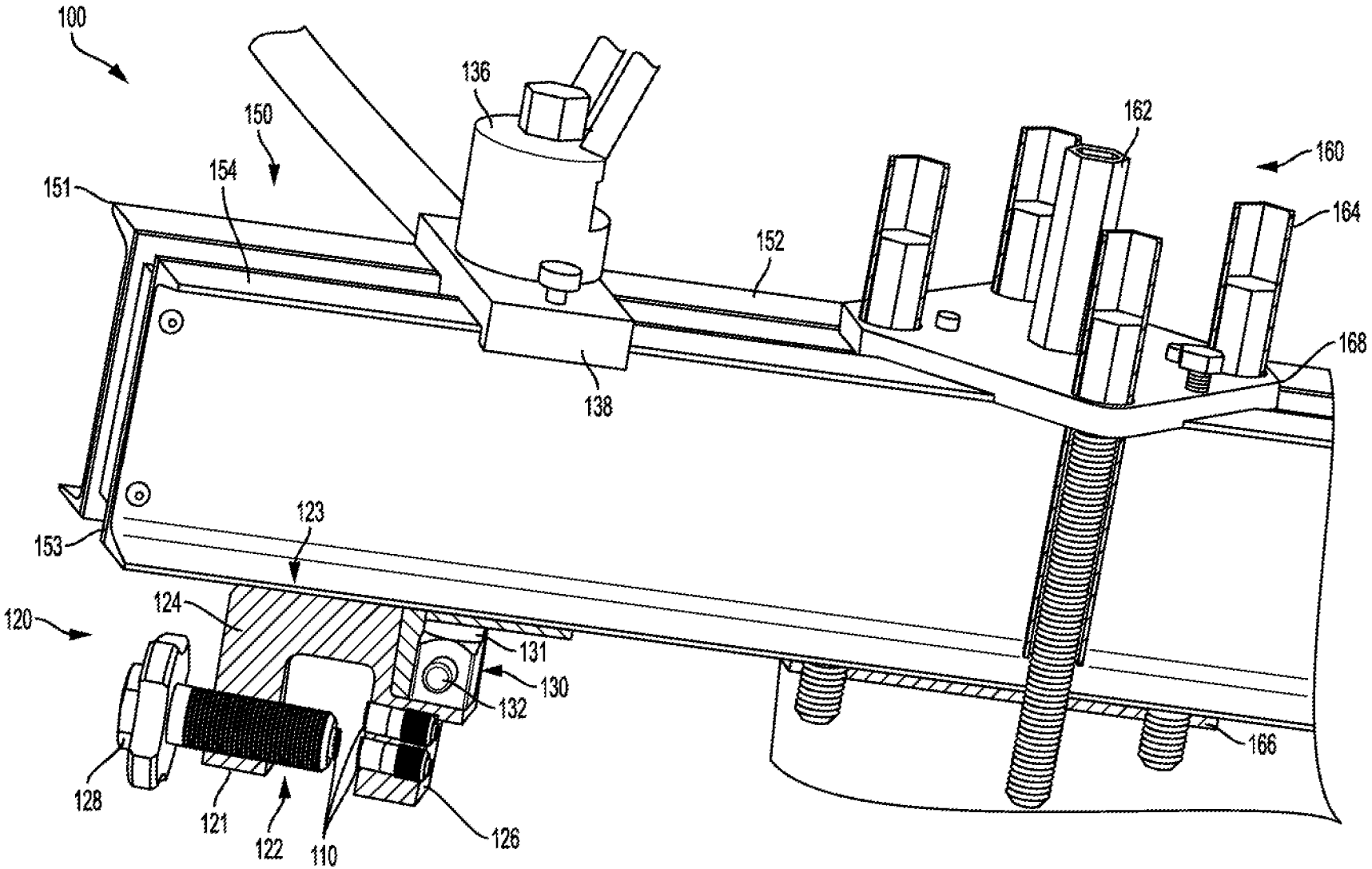
FIG. 4 illustrates an isometric view of an embodiment of a container clamp assembly coupled to an embodiment of a containment assembly.

Referring to FIG. 4, the current containment assembly 100 generally comprises two or more container clamp assemblies 120 coupled to a bridge 150 with a driver assembly 160.

Figure 5:
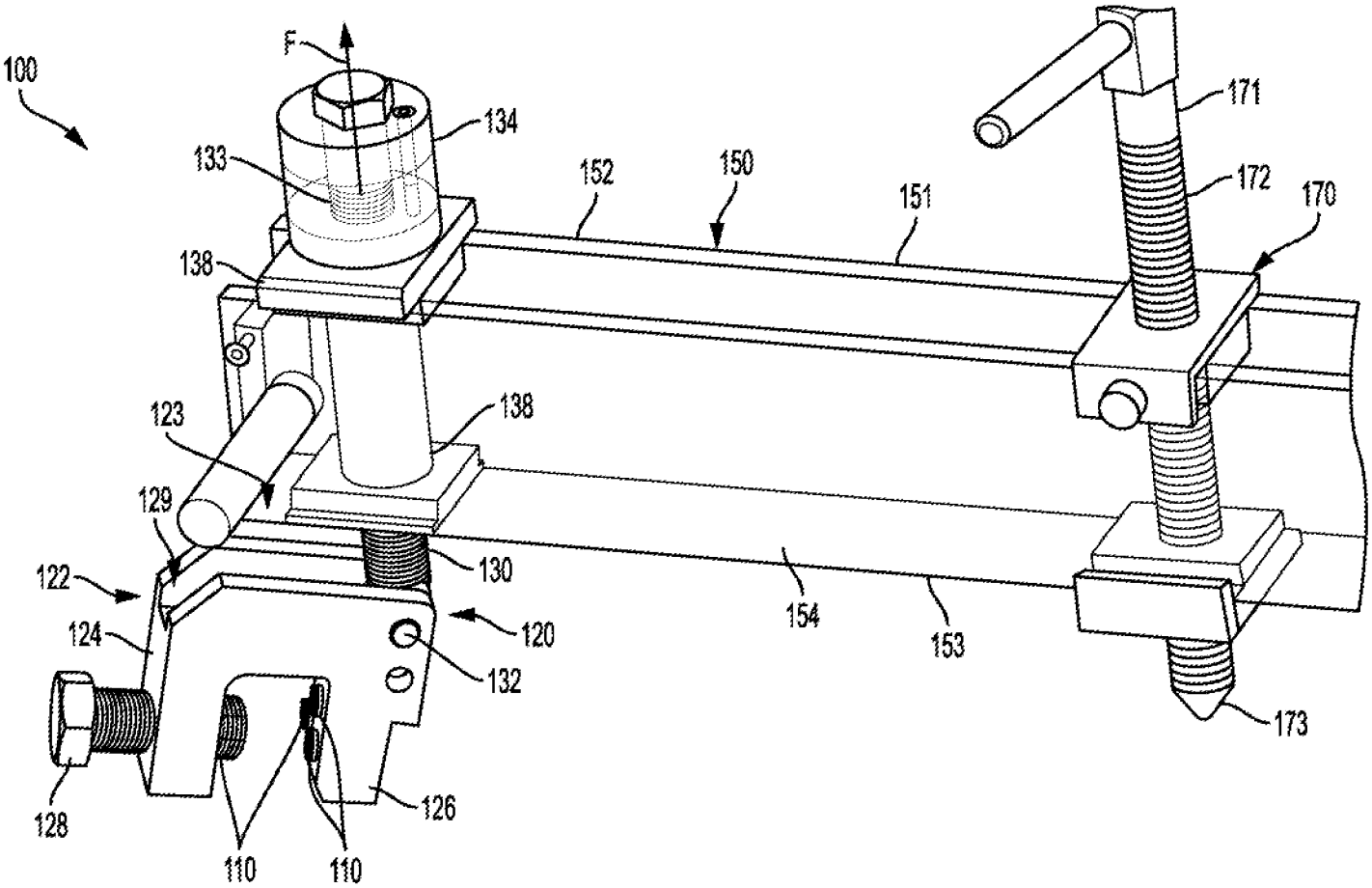
FIG. 5 illustrates a cross-sectional view of an embodiment of the container clamp assembly coupled to a bridge of an embodiment of the containment assembly.
Figure 6:
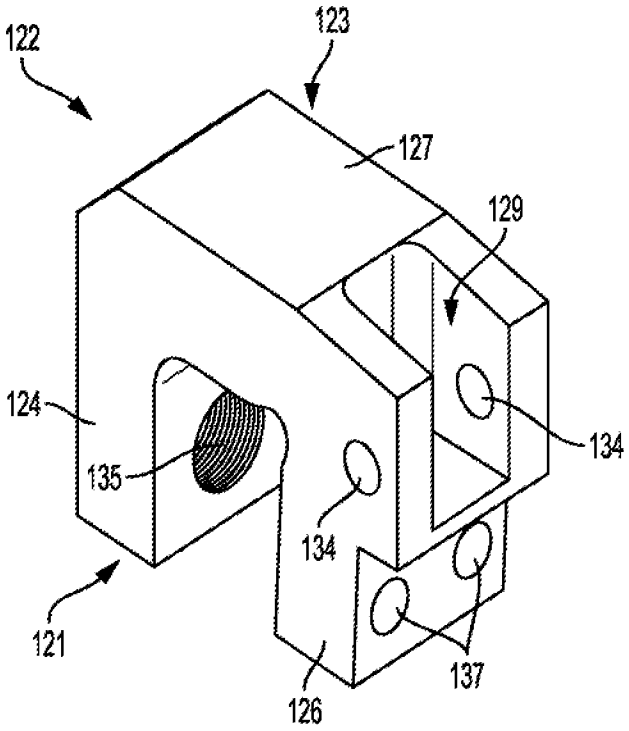
FIG. 6 illustrates an isometric view of an embodiment of a body of the container clamp.

As shown in FIGS. 4-9, each container clamp assembly 120 comprises a body 122 with a front 121 and a back 123. The body 122 further comprises a first leg 124 that is configured to at least partially house or retain an adjustable engager 128 and an opposing second leg 126. The adjustable engager 128 may be a threaded screw that is at least partially held within a threaded opening 135, however other embodiments of the adjustable engager 128 may comprise ratcheted pins, a hydraulic member, or any other suitable means to adjustably engage the container clamp assembly 120 with another surface. As shown in FIGS. 6-10, the second leg 126 and the first leg 124 may be coupled to each other by across member 127. Referring specifically to FIG. 6, the second leg 126 is positioned at an angle $\alpha$ relative to the horizontal axis X (from 0-N degrees or as deemed necessary for the application of the clamp assembly 120). The value of N is not a negative value. As shown in the embodiment illustrated in FIG. 6, the value of N is less than 90°. The second leg 126 may be positioned at an angle $\alpha$ such that the distance between the second leg 126 and the first leg 124 is greatest toward the back 123 of the body 122.

Referring generally to FIGS. 4-11, a plurality of grippers 110 are positioned on the second leg 126 and/or the adjustable engager 128. In an embodiment, the plurality of grippers 110 may be at least partially housed in gripper recesses 137 (FIG. 6). As shown, three (3) grippers 110 are disposed on the second leg 126 and one (1) gripper 110 is disposed on the adjustable engager 128 such that the gripper 110 on the adjustable engager 128 faces the grippers 110 of the second leg 126. In other embodiments, a greater or fewer number of grippers 110 may be positioned on the on the second leg 126 and the adjustable engager 128 than are shown in FIGS. 4-11. As shown, a portion of the grippers 110 extends beyond the surface of the first leg 124 and the second leg 126. Referring to FIGS. 4, 7, 10, 11, and Section A-A of Appendix 1, the grippers 110 on the second leg 126 are arranged in a group of three (3) with two (2) grippers 110 (bottom radius-faced grippers) positioned proximate the front 121 of the body 122. The remaining gripper 110 (top gripper) is positioned between the first two (2) grippers 110, but is closer to the back 123 of the body 122. Referring to the embodiments depicted in FIGS. 8 and 9, the bottom grippers 110 may be arranged in a group of three (3) with two (2) grippers 110 positioned proximate the back 123 of the body 122. In another embodiment, the second leg 126 may include more than three grippers 110.

Figure 7:
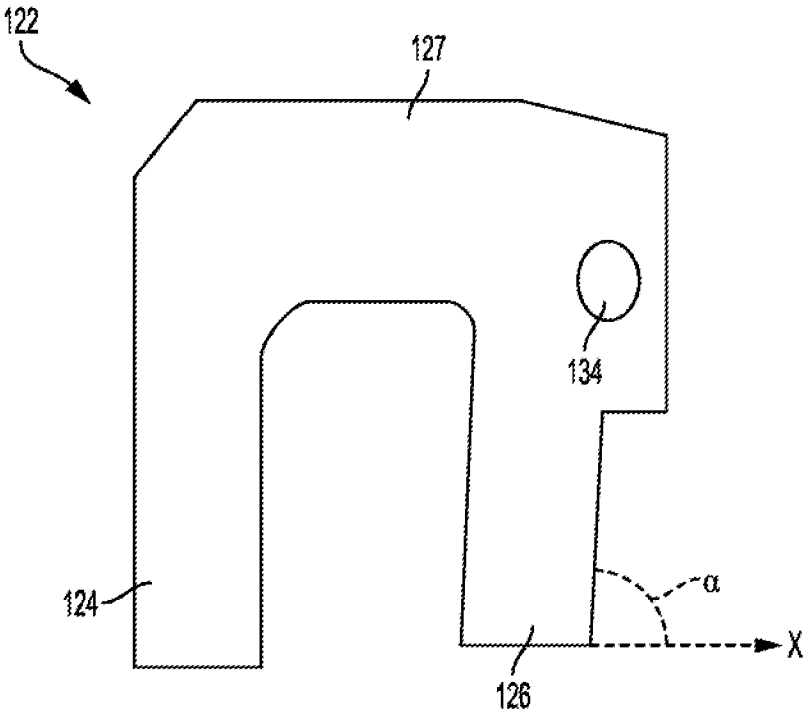
FIG. 7 illustrates a front plan view of an embodiment of the body of the container clamp.
Figure 8:
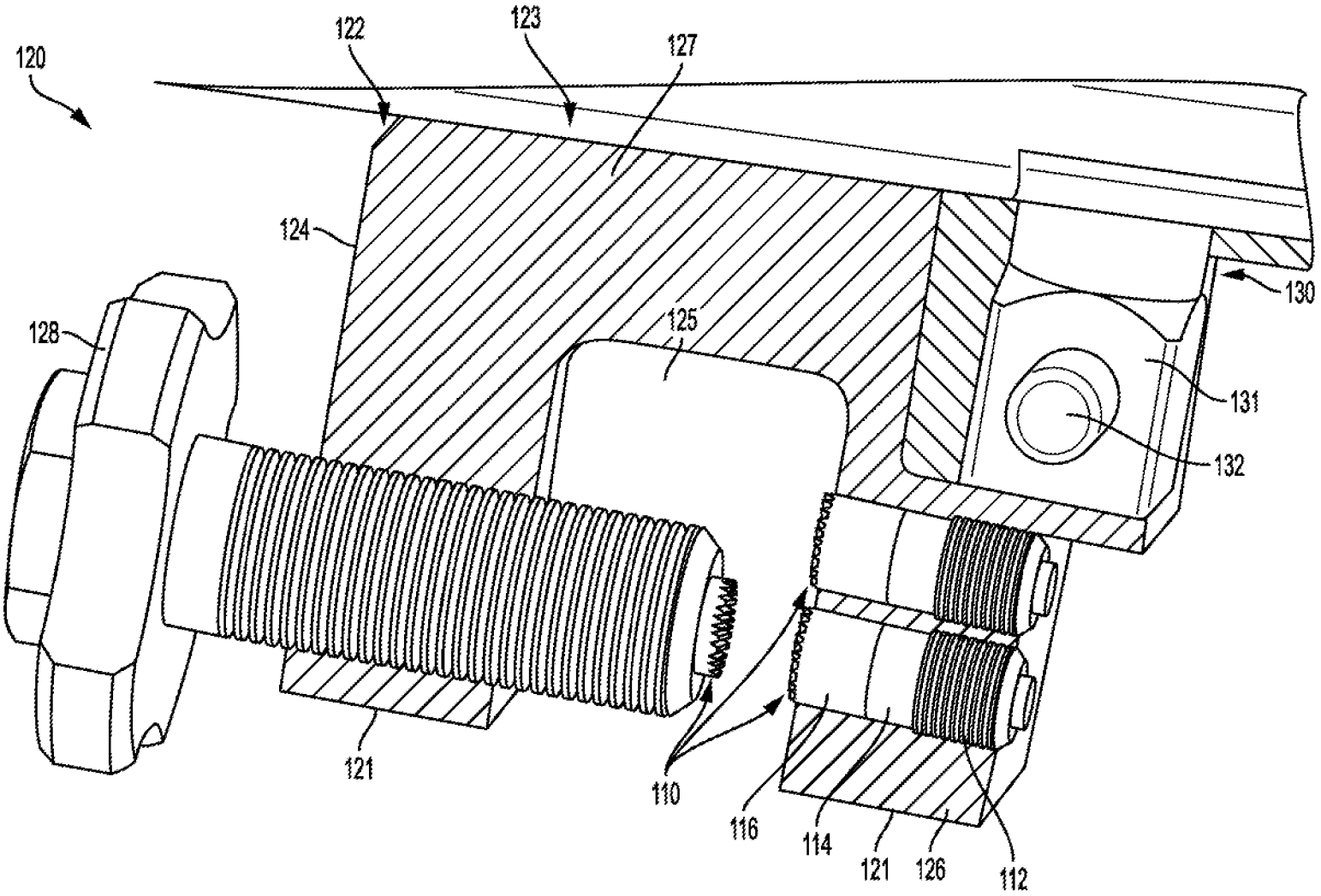
FIG. 8 illustrates a cross-sectional view of an embodiment of the container clamp assembly coupled to a bridge of an embodiment of the containment assembly.
Figure 9:
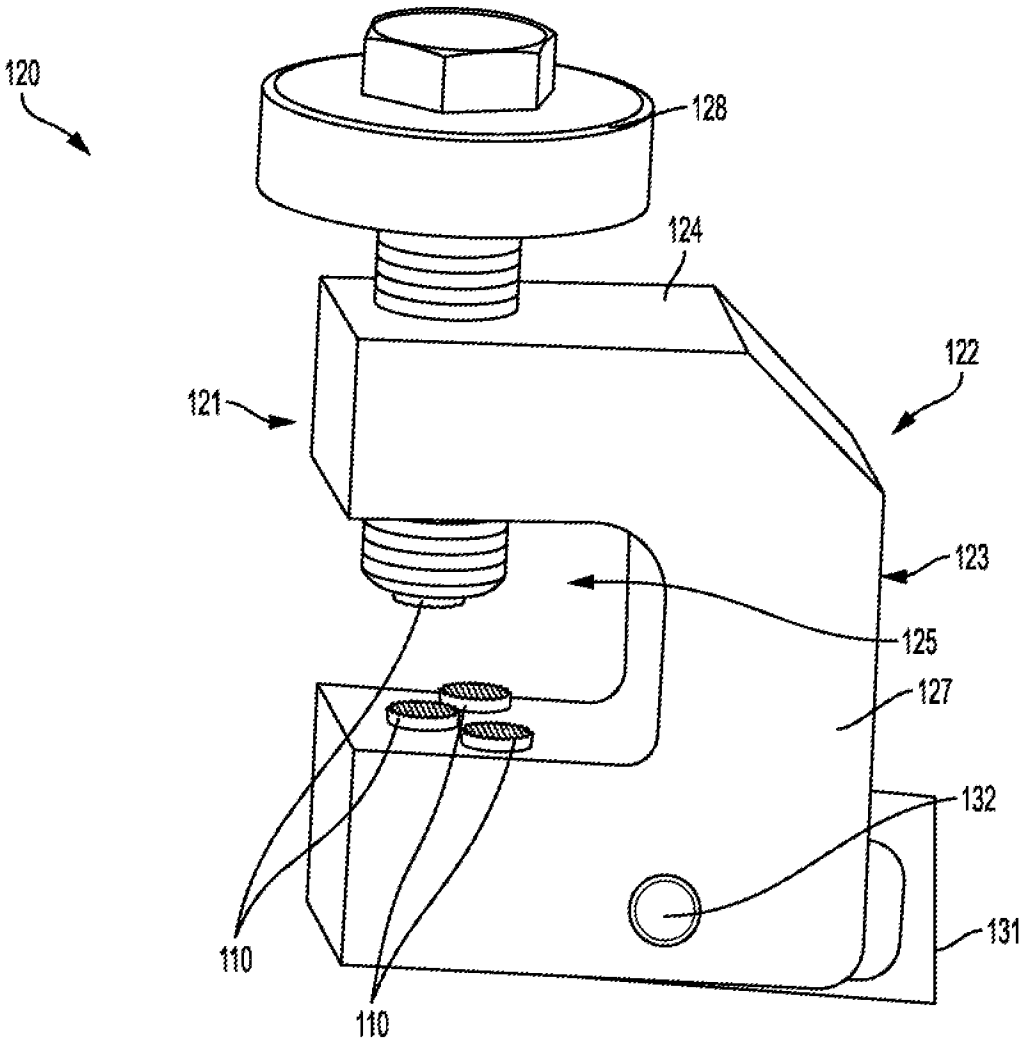
FIG. 9 illustrates an isometric view of an embodiment of the container clamp assembly.
Figure 10:
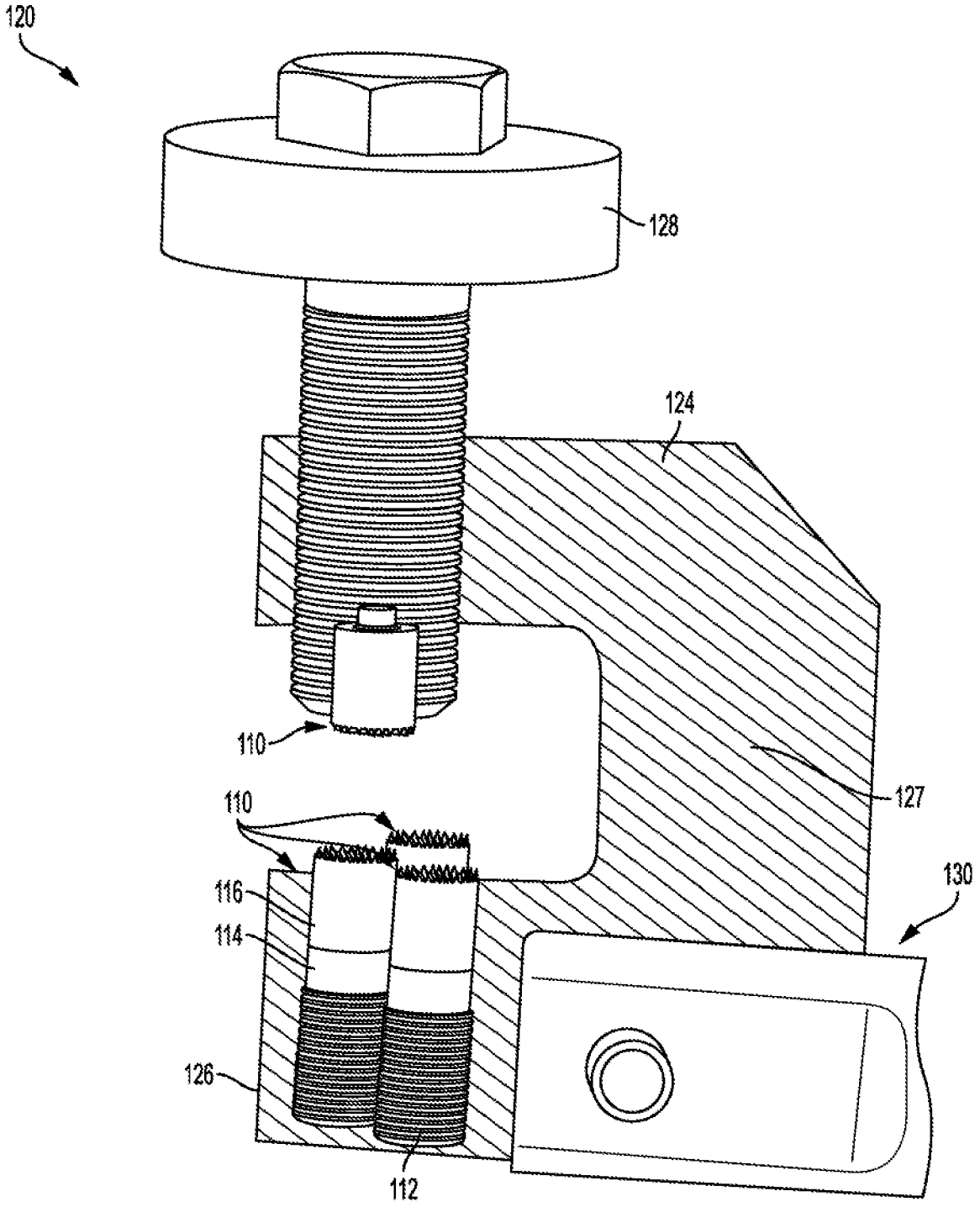
FIG. 10 illustrates a cross-sectional view of an embodiment of the container clamp assembly.
Figure 11:
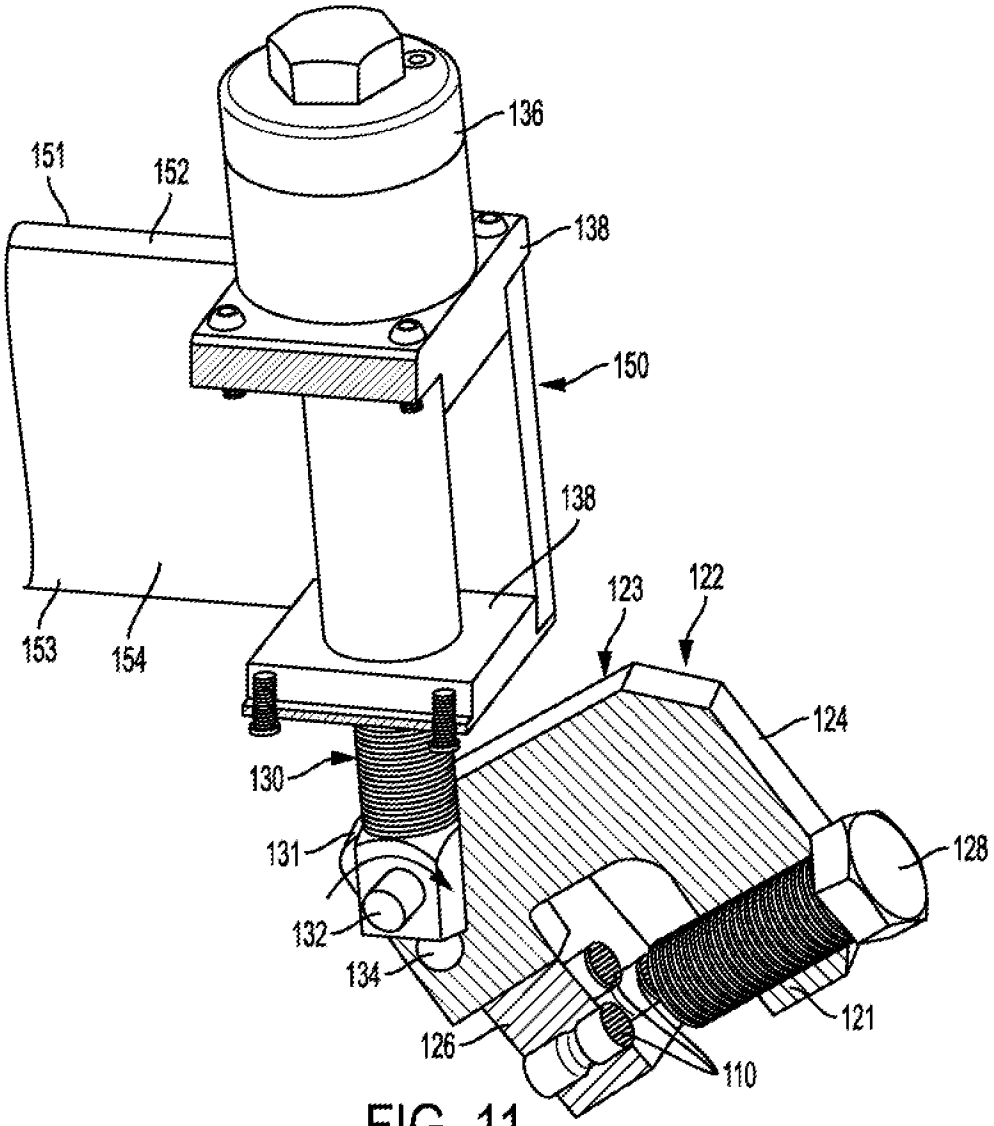
FIG. 11 illustrates an isometric view of an embodiment of the container clamp assembly coupled to an embodiment of the containment assembly.

Referring to FIGS. 7 and 9, each gripper 110 may comprise a threaded portion 112, a transition portion 114 and a gripping portion 116. The threaded portion 112 may be configured to engage a corresponding threaded hole or gripper recess 137 (FIG. 6) in the second leg 126. The gripping portion 116 may be comprised of a different material than the threaded portion 112 and the transition portion 114. As shown, the gripping portion 116 may be comprised of a resilient material having a rounded face, ridges, bumps, mounds, or other surface feature configured to increase the gripping ability of the gripping portion 116. The transition portion 114 may couple the threaded portion 112 to the gripping portion 116. In an embodiment, the threaded portion 112, transition portion 114, and the gripping portion 116 may be separate pieces that are temporarily or permanently coupled together. In another embodiment, one or more of the threaded portion 112, transition portion 114, and gripping portion 116 may be formed as a single unitary component. In another embodiment, the grippers 110 may not include one or more of the threaded portion 112 and transition portion 114 and may be coupled to the second leg 126 or adjustable engager 128 using adhesive, one or more welded joints, or any other suitable means to securely couple the gripping portion 116 to the desired surface. Referring to FIGS. 3 and 4, the gripping portions 116 of the bottom grippers 110 may extend farther beyond the surface of the second leg 126 than the gripping portion 116 of the top gripper 110. In another embodiment, the gripping portions 116 of the bottom grippers 110 may not extend beyond the surface of the second leg 126 than the gripping portion 116 of the top gripper 110.

Referring to FIG. 5, the container clamp assembly 120 is configured to rotate about a pin 132 disposed in a pin hole 134 which allows the container clamp assembly 120 to be rotated to achieve a variety of positions. The pin 132 is configured to couple a first end 131 (FIGS. 2, 3, and 5) of the rod 130 to the container clamp assembly 120 proximate the second leg 126 of the body. Referring to FIG. 5, the rod 130 and the body 122 may include at least one pin hole 134 configured to accept the pin 132. As shown in Appendix 1, the body 122 of the container clamp assembly 120 may comprise a recess or channel 129 configured to accept the first end 131 of the rod 130. As shown, the one or more pin holes 134 (Appendix 1) disposed on the body 122 proximate the second leg 126 are positioned such that a force exerted on the rod 130 in the direction F (FIG. 4) causes the body 122 to rotate toward the first leg 124. The rotation further pinches or clamps a portion of the protective housing 180 (FIG. 6) between the first leg 124 and the second leg 126.

As shown in FIG. 4, the back 123 of the body 122 of the container clamp assembly 120 defines the channel 129 configured to at least partially receive a portion of the rod 130 in order to increase the ability of the body 122 to rotate about the pin 132. The rotation of the body allows the container clamp assembly 120 to accommodate a variety of valve and container configurations. Moreover, the container clamp assemblies 120 do not need to be positioned in the preexisting holes 184 (FIGS. 1 and 2) such that removal of hoses/pipes 30 (FIG. 2) from unaffected valves 12 during the containment procedure is not required.

As shown in FIGS. 2, 4, and 5, the rod 130 extends from the first end 131 coupled to the container clamp assembly 120 to a second end 133. As shown, the second end 133 may be threaded and can be disposed above the bridge 150 such that the bridge 150 is positioned between the container clamp assembly 120 and the second end 133. A portion of the rod 130 may be housed within the bridge 150 or may be disposed between two or more support members 152, 154 comprising the bridge 150. The second end 133 of the rod 130 may be secured to the bridge 150 using a nut 136, cap, pin, or any other suitable means to securely couple the second end 133 of the rod 130 to the bridge 150 to restrain axial movement of the rod 130. In an embodiment, additional fastening members may be used to secure the second end 133 of the rod 130 to the bridge 150 such as one or more fastening surfaces 138.

Still referring to FIGS. 2, 4, and 5, the bridge 150 includes a top 151 and a bottom 153. As shown, the bridge 150 comprises a first support member 152 and a second support member 154, however other embodiments of the bridge 150 may not comprise two support members 152, 154. The length and width of the bridge 150 may vary according to its intended use. The first 152 and second 154 support members may be comprised of aluminum, steel, carbon fiber, or any other suitable strong, lightweight material capable of holding up under high levels of axial stress. In an embodiment, a carbon fiber or carbon composite support may be disposed between the first support member 152 and the second support member 154 to increase the strength of the bridge 150 without adding excess weight.

Referring to FIG. 2, a driver assembly 160 can be coupled to the bridge 150 using one or more fastening surfaces 168 and fasteners 164. The driver assembly 160 further comprises a driver 162 that is configured to be advanced in a direction toward the bottom 153 of the bridge 150. As shown in FIG. 2, the driver can be coupled to a driver plate 166. The driver plate 166 is configured to engage and apply axial pressure to the hood 190 (FIG. 6) in order to seal off the leaking valve 12 (FIG. 1) or fuse plug 11 (FIG. 1). An alternate embodiment of the driver assembly 170 is illustrated in FIG. 4. As shown, the alternate driver assembly 170 comprises a driver 172 with a first end 171 and a second end 173. The first end 171 of the driver 172 may include a handle to assist in the advancement of the driver 172 toward the bottom 153 of the bridge 150. As shown the driver 172 can be a threaded screw, however in other embodiments the driver 172 may comprise a ratcheted rod, hydraulic element, or other such element or assembly suitable to easily and securely apply axial pressure to the hood 190 (FIG. 6).

As shown in FIG. 6, a containment apparatus 100 as described in the current specification is installed onto the protective housing 180 of a chemical container (not shown). Installation of the containment assembly 100 comprises providing at least two container clamp assemblies 120 each coupled to a rod 130. The rods 130 may each be coupled to the bridge 150 using a nut 136 or other fastening member to secure the second end 133 (FIG. 3) of each rod 130 to the bridge 150. As shown, the nut 136 is secured against a fastening surface 138 such that it may be loosened to slide the corresponding container clamp assembly 120 along the axis of the bridge 150 to accommodate different configurations as required by the location of the leaking valve 12 (FIG. 1) or fuse plug 11 (FIG. 1). This also provides easy adjustment of the container clamp assemblies 120 to accommodate different types of chemical containers (not shown) and valve configurations. Once the bridge 150 is positioned over the leaking valve, the container clamp assemblies 120 are positioned onto the container over the protective housing 180 and then the nuts 136 are tightened to prevent further movement along the axis of the bridge 150. A portion of the protective housing 180 is positioned within the retaining area 125 (FIG. 3) of each of the container clamp assemblies 120 and the adjustable engagers 128 of the container clamp assemblies 120 are rotated or adjusted to provide an initial retention of the portion of the protective housing 180 between the adjustable engager 128 and the second leg 126.

A hood 190 is then placed over the leaking valve or fuse plug. The driver assembly 160 (FIG. 2) is then coupled to the bridge 150 and positioned over the hood 190. The driver 162 (FIG. 2) is rotated or otherwise driven to advance the driver plate 166 toward the hood 190. Once the driver plate 166 contacts the hood 190, additional pressure is applied to the hood 190 by the driver 162 (FIG. 2) and driver plate 166 in order to seal the hood 190 (FIG. 6) in place over the leaking valve 12 (FIG. 1) or fuse plug 11 (FIG. 1). The additional pressure exerted by the driver 162 also causes an opposing force to act on the bridge 150. The opposing force causes the bridge to push up on the fastening surface 138, and exert an upward force on the rods 130 (FIGS. 2-5) in the direction F (FIG. 4). The upward force exerted on the rods 130 causes the body 122 of the container clamp assemblies 120 to rotate in a direction toward the first leg 124, further pinching the portion of the protective housing 180 positioned in the retaining area 125 of the container clamp assembly 120 between the adjustable engager 128 and the second leg 126. Accordingly, the more pressure that is applied to the hood 190 by the driver 162 (FIG. 2), the more secure the container clamp assemblies 120 become against the protective housing 180. It can be appreciated that installation of the container clamp or any other part of the containment assembly may be performed in a different order than was described above.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claim. Moreover, although specific terms are employed herein, as well as in the claim which follows, they are used only in a generic and descriptive sense, and not for the purposes of limiting the present disclosure, nor the claim which follows.

The invention claimed is:

1. A clamping assembly comprising:

a body defining comprising, at least one coupling element, a forward surface and a rearward surface, a first leg, a second leg, and a cross member having a length that extends along an axis and, the cross member configured to couple the first leg to the second leg;

an adjustable engagement member coupled to the first leg;

at least one gripping element disposed on the adjustable engagement member;

a plurality of gripping elements positioned on the second leg; and a rod extending along an axis that intersects the axis of the cross member, the rod having a first end pivotally coupled to the at least one coupling element of the body and a second end opposite the first end, wherein the rod is configured to drive the body in a direction toward the first leg in response to a force directed toward the second end of the rod, and wherein the body further comprises a plurality of recesses configured to house a portion of each of the plurality of gripping elements.

2. The clamping assembly of claim 1, wherein the second leg is positioned at an angle less than 90° relative to a horizontal axis.

3. The clamping assembly of claim 1, wherein the adjustable engagement member is a threaded screw.

4. The clamping assembly of claim 1, wherein each of the plurality of gripping elements positioned on the second leg further comprise a gripping portion comprising one or more surface features configured to increase a gripping ability of each of the plurality of gripping elements.

5. The clamping assembly of claim 4, wherein the gripping portion of each of the plurality of gripping elements extends beyond a surface of the second leg.

6. The clamping assembly of claim 1, wherein the first leg defines an opening configured to accept at least a portion of the adjustable engagement member.

7. The clamping assembly of claim 1, wherein the body further comprises a channel configured to at least partially receive a portion of the rod.

8. A clamp assembly comprising:

a body comprising, a first leg defining an opening, and a second leg positioned at an angle less than 90° relative to a horizontal axis;

a plurality of gripping elements coupled to the second leg, and a cross member having a length that extends along an axis, the cross member coupled to the first leg at one end and the second leg at an opposite end;

an adjustable engager at least partially positioned within the opening; and an extension extending along an axis, wherein the axis of the extension intersects the axis of the cross member, the extension pivotally coupled to the body at one end and configured to drive the body in a direction toward the first leg in response to a force directed toward an opposing second end of the extension, wherein the plurality of gripping elements further comprise a threaded portion configured to couple to the second leg and a gripping portion comprising a plurality of surface features.

9. The clamp assembly of claim 8, wherein the first leg defines an opening configured to accept at least a portion of the adjustable engager.

10. The clamp assembly of claim 8, wherein each of the plurality of gripping elements further comprise a gripping portion comprising one or more surface features configured to increase a gripping ability of each of the plurality of gripping elements.

11. The clamp assembly of claim 8, wherein the gripping portion of each of the plurality of gripping elements extends beyond a surface of the second leg.

* * * * *